United States Patent [19]

Harbom et al.

[11] Patent Number: 5,058,321

[45] Date of Patent: Oct. 22, 1991

[54] PIVOTING & LOCKING DEVICE FOR A WINDOW OR DOOR SASH

[75] Inventors: John Harbom, Bolton; Allan Skjodt, Caledon East, both of Canada

[73] Assignee: Plastmo Ltd., Brampton, Canada

[21] Appl. No.: 680,875

[22] Filed: Apr. 5, 1991

[51] Int. Cl.[5] ..... E05D 15/22

[52] U.S. Cl. ..... 49/177

[58] Field of Search ..... 49/177, 178, 179, 180, 49/174, 175

[56] References Cited

U.S. PATENT DOCUMENTS 4,222,201 9/1980 Yanessa ..... 49/174 X
4,337,597 7/1982 Struckmeyer ..... 49/174 X
4,559,739 12/1985 Bayer ..... 49/177
4,888,915 12/1989 Goldenberg ..... 49/177 X

*Primary Examiner*—Philip C. Kannan
*Attorney, Agent, or Firm*—Arne I. Fors

[57] ABSTRACT

A pivoting and locking device for slidable window or door sash for retaining the window or door sash in engagement with the frame when pivoted out of planar alignment with the frame. A slide block slidably mounted within the frame and pivotally connected to the sash has means for selectively engaging apertures formed in the frame for locking one end of the sash at top and bottom to the frame while permitting the sash to pivot from the frame.

14 Claims, 4 Drawing Sheets

PIVOTING & LOCKING DEVICE FOR A WINDOW OR DOOR SASH

BACKGROUND OF THE INVENTION

This invention relates to a pivoting and locking device for a slidable window or door. More particularly, it relates to a pivoting and locking device for retaining the sash of a horizontally slidably window or door in engagement with the frame while being pivoted out of planar alignment from the frame.

It is customary in vertically slidable window sash and frame construction that some means be provided for releasing the sash from the frame while maintaining one end of the sash secured. The sash can then be pivoted inwardly to permit washing of the outer surface of the window pane without creating a serious hazard.

In the case of horizontally slidable windows or doors, however, a sash that is disconnected from the frame and pivoted along one side may drop out of the top-track of the frame as the weight of the window or door sash may not then be fully supported in the vertical position. The applicant has created a device which is attachable at the trailing end of the sash, at the bottom and the top thereof, so that the sash can be pivoted inwardly from the frame and yet be secured in the frame at both the upper and lower end.

It is therefore an object of this invention to provide a pivoting and lock engaging device for securely retaining a horizontal sash in upwardly non-sagging position when in pivoted outward disengagement from the frame.

It is an object of another aspect of this invention to provide a pivoting and lock engaging device for permitting a horizontally slidable window or door sash to be pivoted out of planar alignment from the supporting frame.

SUMMARY OF THE INVENTION

These and other objects of the invention are achieved by means of a pivoting and lock engaging device for use in cooperation with the sash and frame of a horizontally slidable window or door, said device comprising: a slide block slidably mounted within said frame; pivoting means interconnecting said slide block and sash for pivoting said sash away from planar alignment with said frame; a vertical opening through said slide block and spaced from said sash, with a lock engaging rod axially aligned therein, said lock engaging rod being spring biased within said opening whereby the leading end of said rod is engageable within a predetermined aperture located along said frame; and a gripping tab at the opposite end of said rod for manually axially disengaging the rod from said aperture and a support pinion on said slide block for receiving said tab and retaining said rod in such disengagement.

BRIEF DESCRIPTION OF THE DRAWINGS

The pivoting and locking device of the invention will now be described with reference to the accompanying drawings, in which.

DESCRIPTION OF THE PREFERRED EMBODIMENT

Figure 1:
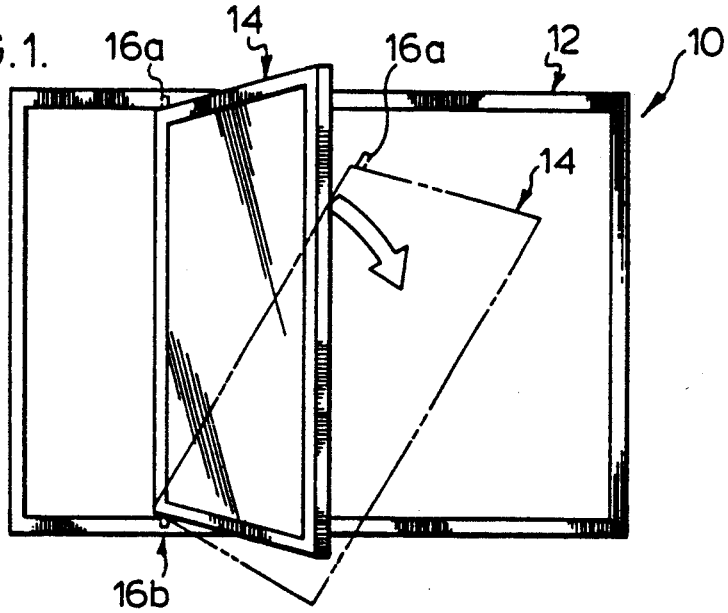
FIG. 1. (PRIOR ART)
FIG. 1 is a front elevation of a horizontally slidable sash pivoted out of planar alignment from a window frame of the prior art with the sash further shown in broken perspective outline when on pivot end becomes disconnected.

In FIG. 1 a window 10 is shown consisting of a frame 12 with a window sash 14 horizontally slidable therein. The window sash 14 is capable of being released from the frame track at one end and pivoted inwardly on pivot arms **16*a* and 16*b*** so that the outside surface of the window pane can be easily cleaned. This is a conventional pivoting means for a window sash as used in the prior art.

As can be seen in broken outline of sash 14, the weight of the sash is not fully supported at its upper end in this construction and pivot arm **16*a*** is slidable out of the upper frame track (not shown). The entire sash can drop out of the frame thereby breaking the window or injuring the cleaner.

This hazard is overcome by incorporating the device 100 of the present invention at the pivoting junction between the sash and frame. Such a device is shown at the upper and lower corners of the trailing end of the window or door sash in FIG. 2.

Figure 3:
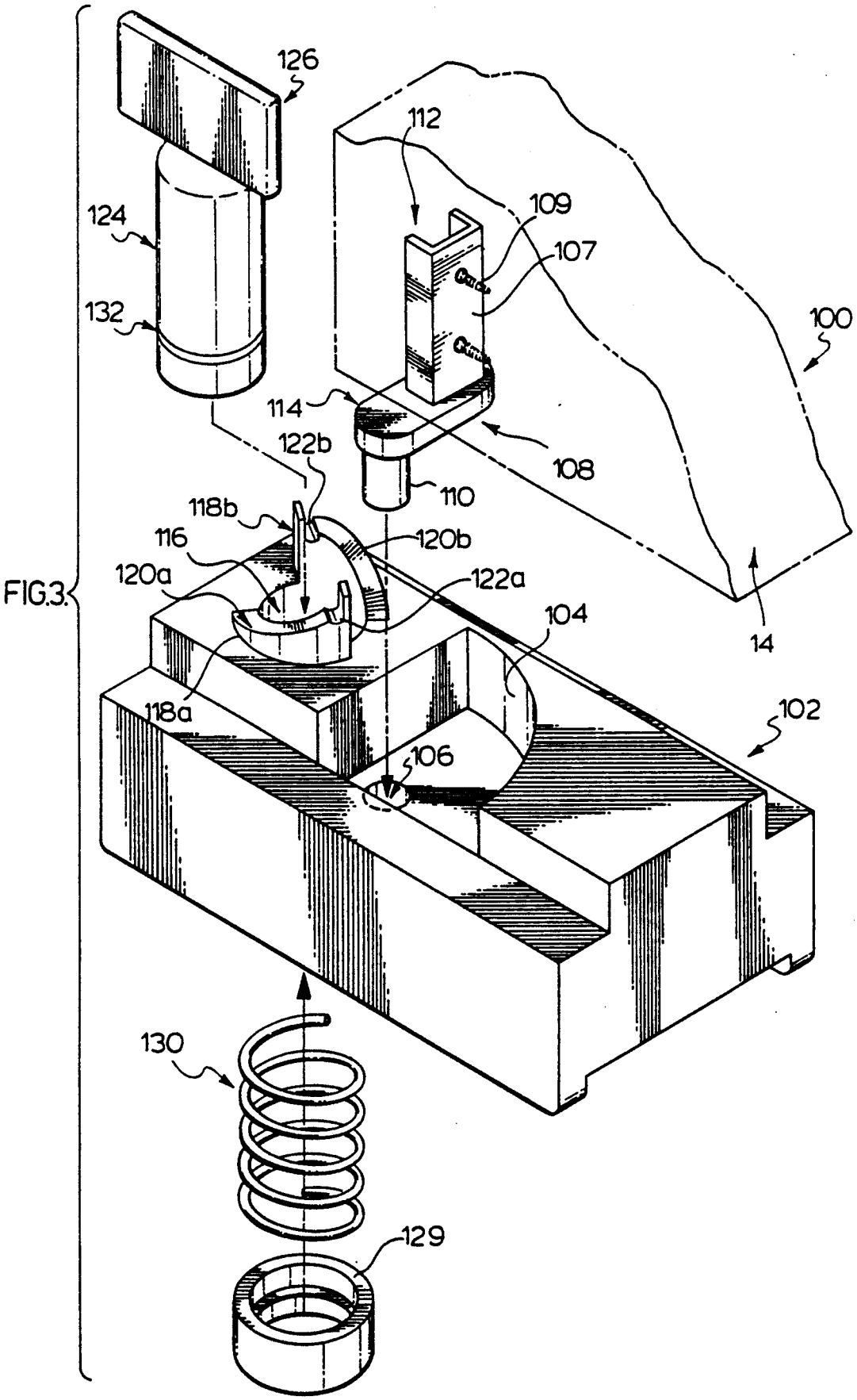
FIG. 3 is an exploded perspective view of the device of the present invention.

A detailed construction of the device is shown in FIG. 3. This includes a slide block 102 having dimensions contoured to fit within the bottom and top sliding track 134 of the frame shown in more detail in FIG. 6. The upper surface of slide block 102 includes an arcuate indentation 104 with a cavity 106 located laterally of and offset from the center of block 102. A pivot hinge 108 mounted on sash 14 includes a mating pinion 110 for axial insertion into and rotation within cavity 106. Hinge 108 is secured to sash 14 by means of a vertical hinge plate 107 that is fixed to sash 14 by screws depicted by numeral 109. Pinion 110 is secured to and off-set laterally from the vertical hinge plate 107 by rotor arm 114.

When pinion 110 is axially mounted within cavity 106, sash 14 may be pivoted with respect to slide block 102. Arcuate indentation 104 permits the swing of the rotor arm 114 during pivoting. It will be understood that hinge plate 107 is sufficiently spaced above arm 114 so that the sash rides above the upper surface of slide block 102 and is allowed to pivot within the arc defined by the arcuate indentation 104. This pivoting construction allows sash 114 to pivot outward and away from the slide block and accompanying window frame without hinderance.

Slide block 102 includes a vertical opening 116 at one end of said block and spaced from the mounted sash. A pair of diametrically opposed arcuate ramps or pillars **118*a* and 118*b* are spaced apart on opposite sides of opening 116. These include upwardly rising top surfaces or ramp surfaces 120*a* and 120*b* respectively which are positioned in opposite elevation for purposes to be explained below. The pillars include retaining notches 122a and 122b** at the upper ends of the respective ramps.

A lock engaging rod 124 is mounted within vertical opening 116 and is axially slidable therewithin. Rod 124 includes a gripping tab 126 at the upper end and a retaining collar 128 fitted at the lower end to restrain compression spring 130 coaxially around the shaft of rod 124. The inner flange 129' of retaining collar 128 is secured by a snap-fit into the retaining groove 132 of the rod.

Figure 4:
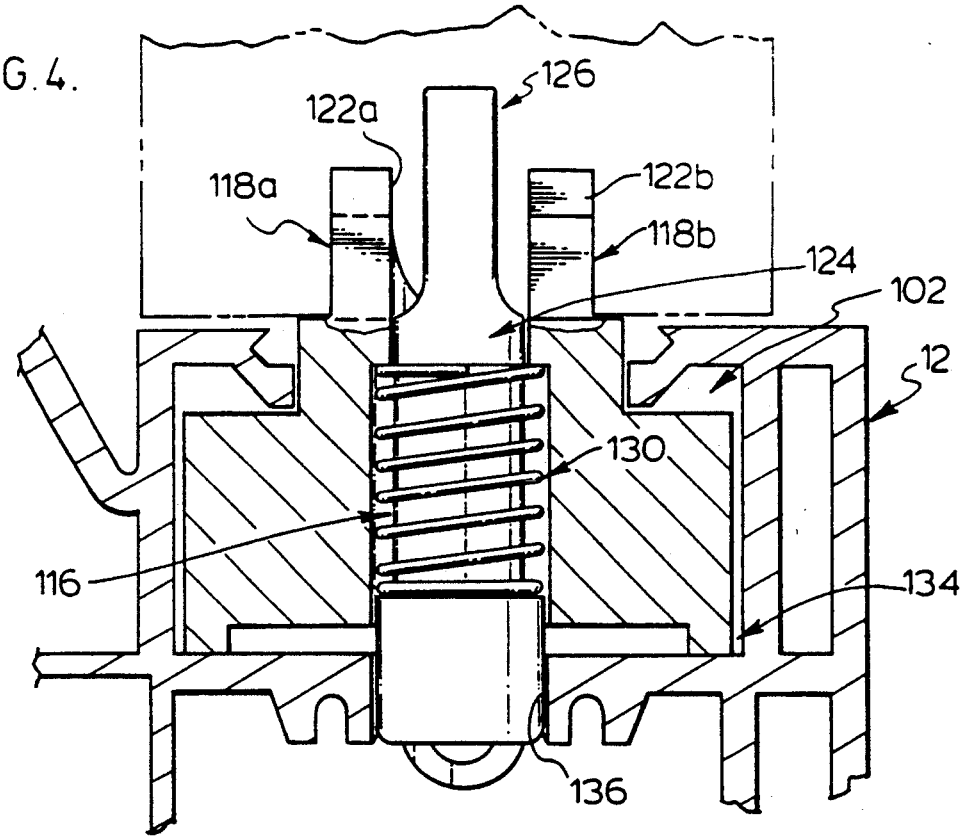
FIG. 4 is cross-sectional side elevation of the said device in locking engagement with the window or door frame.
Figure 5:
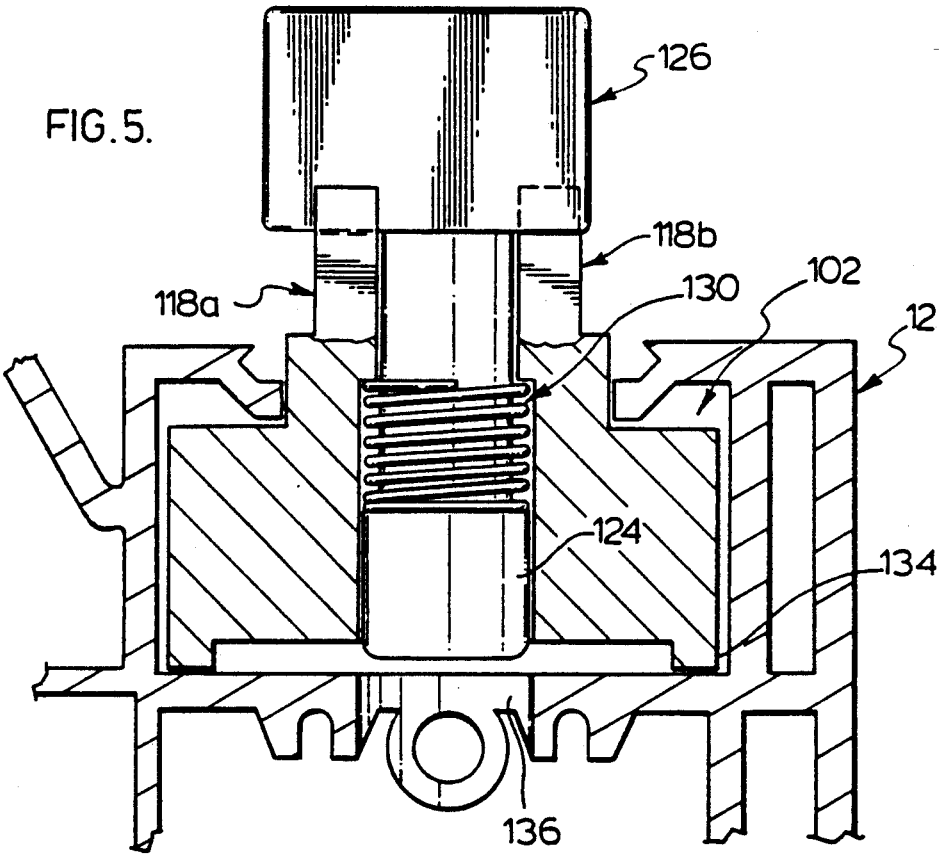
FIG. 5 is a cross sectional side elevation of the said device in locking disengagement with the window or door frame.

The assembly of the various elements and their interaction is shown with particular reference to FIGS. 4 and 5. FIG. 4 is an end cross-section showing sliding block 102 slidably mounted within track 134 of a window or door frame 12. In FIG. 4, the leading end of rod 124 is shown axially located in block opening 116 in the down position where it is locked into a frame aperture 136 located at the base of track 134. In this position, the gripping tab 126 has been turned to be free of pillars 118 so that compression spring 130 biases the rod into the fully extended down position.

To effect release of rod 124 from aperture 136, the rod is drawn upwardly against the force of the compression spring 130 by rotation of gripping tab 126 on the rising ramps 120a and 120b respectively of pillars 118a and 118b. The pillars hold the tab and attached rod out of aperture 136 so that slide block 102 is then allowed to freely slide within track 134. When rod 124 is thus held in the upright position, spring 130 is compressed and ready to direct the rod downwardly again should the gripping tabs be released.

Figure 6:
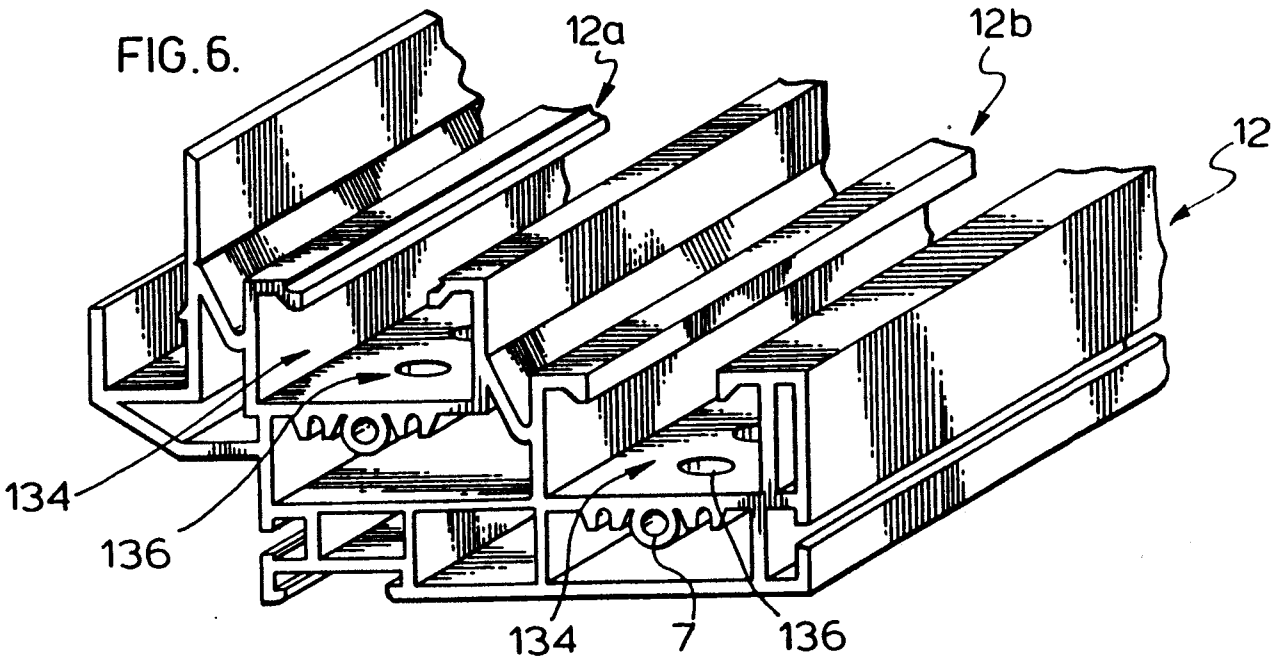
FIG. 6 is a cross-sectional perspective of a section of the window or door frame.

In FIG. 6, a cross-section of window or door frame 12 is shown containing an outer frame 12a and an inner frame 12b to provide mounting for slide blocks for outer and inner sashes respectively. Each of said outer and inner window or door frames include a track 134 with a series of one or more frame apertures 136. The mounted window sashes are horizontally slid within the respective frames, carrying their attached pivoting and locking device along with them. The engaging rod in each device is then manually released to slide downwardly into one of the predetermined apertures 136 along the travel path of the sash. The sash is thus held at the pivot point while it is otherwise released to pivot in along the vertical axis of one side of the sash when the sash is released from the frame.

Figure 2:
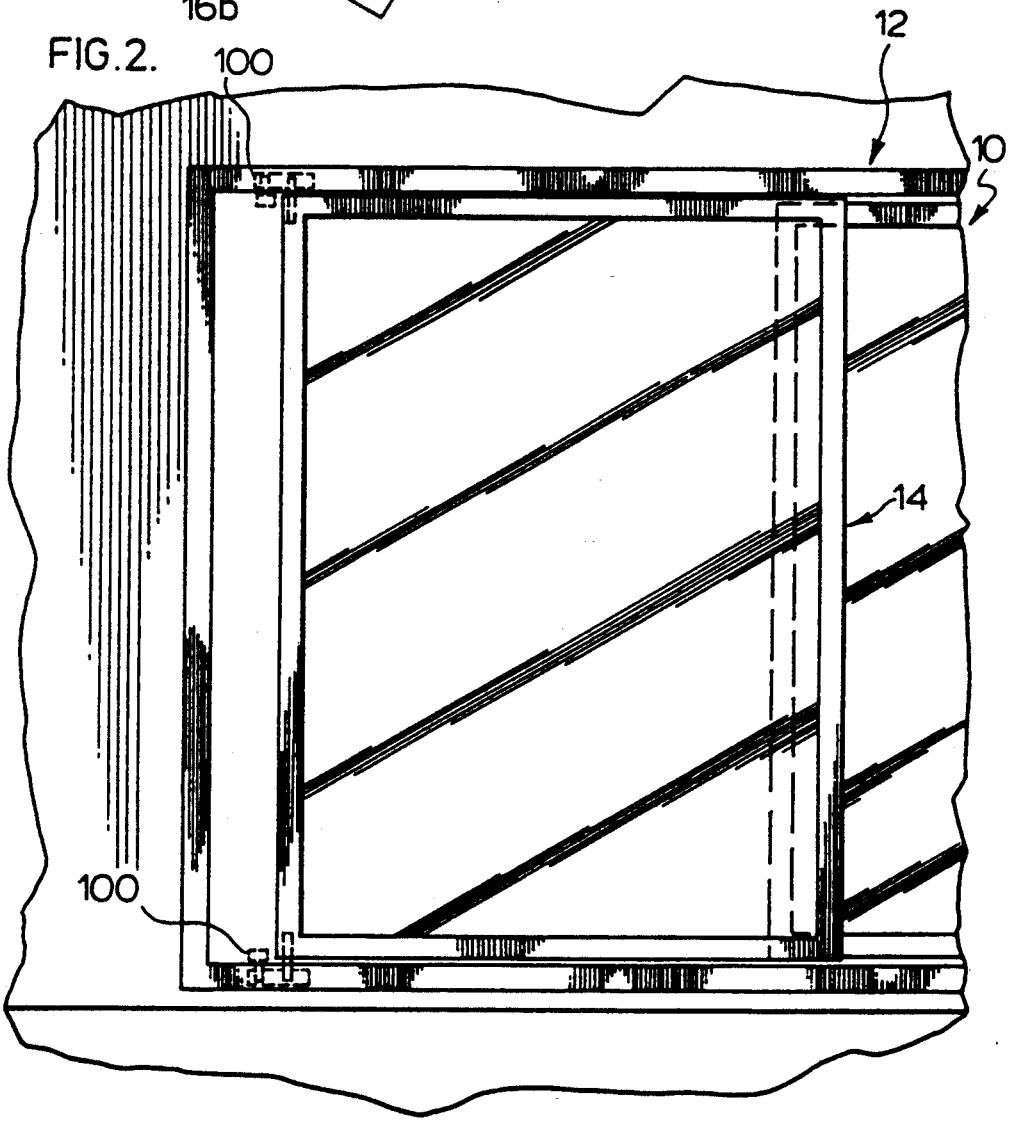
FIG. 2 is a partial front elevation of a window or door sash and frame incorporating the device of the present invention.

The pivoting and locking device of the present invention is mounted at the top and bottom corners of the trailing end of a slidable window or door sash in the manner shown more particularly in FIG. 2. When the sash is normally fitted into position on the frame, the respective upper and lower lock engaging rods are normally held in their retracted position with their axial springs compressed in the manner shown in FIG. 5. The gripping tab is held in position on the opposed pillars to hold the leading end of the rod out of contact with the window or door frame track and any aperture that might be located in that area.

In the particular embodiment shown in FIG. 3, the opposed pillars 118a and 118b include upwardly rising ramps 120a and 120b respectively. When the rod is in the retracted position of FIG. 5, the bottom surfaces of the ends of gripping tab 126 rest in retaining notches 122a and 122b. In such retracted position, the sash is freely slidable within the window or door frame and carries the sliding blocks of the devices along with it.

When a window, for example, is to be washed on its outer surface, the sash is slid along the frame to a point where the lock engaging rods 124 are released from the retaining notches 122 and rotated so that gripping tabs 126 slide down along the ramps allowing rods 124 to be extended axially into locking engagement with apertures 136, as viewed in FIG. 4, as sash 14 continues to be slid along the frame to lock the window sash in place along its trailing side. The window sash is otherwise disengaged from the frame in a conventional manner, at its other end, so that it swings inwardly to make the surface of the glass readily available for washing.

When washing has been completed, the sash is fitted back into the frame and the locking rods disconnected from their respective apertures by rotating the gripping tabs in the opposite direction. This causes the engaging tabs to slide up the ramp surfaces of the opposed pillars until they contact the retaining notches at the upper end, as viewed in FIG. 5, whereby rods 124 are retracted from engagement with the frame so that the sash is once again freely slidable within the track of the frame.

It will be understood that various modifications can be made without departing from the essential features of the invention as particularly disclosed or from the scope of the appended claims.

We claim:

1. A pivoting and lock engaging device for use in cooperation with the sash and frame of a horizontally slidable window or door, said device comprising:

a) a slide block slidably mounted within said frame;

b) pivoting means interconnecting said slide block and sash for pivoting said sash away from planar alignment with said frame;

c) a vertical opening through said slide block and spaced from said sash, with a lock engaging rod axially aligned therein, said lock engaging rod being spring biased within said opening whereby the leading end of said rod is engagable within a predetermined aperture located along said frame; and d) a gripping tab at the opposite end of said rod for retracting and axially disengaging the rod from said aperture and a support pillar on said slide block for receiving said tab and retaining said retracted rod in such disengagement.

2. A device as claimed in claim 1 wherein said support pillar comprises a pair of pillars on diametrically opposed sides of said slide block opening.

3. A device as claimed in claim 2 wherein each of said pillars has an upper surface of predetermined rising elevation whereby axial rotation of said gripping tab in one direction will cause the tab to ride up on said upper surface and thereby axially withdraw the rod within said opening, and axial rotation of said tab in the opposite direction will permit said rod to axially descend in said opening.

4. A device as claimed in claim 3 wherein each of said opposed pillars include a tab engaging surface at the upper end of said upper surface for retaining said tab and maintaining said rod retracted in disengagement within said opening.

5. A device as claimed in claim 4 wherein said pivoting means includes a pivot hinge comprising a pinion for engaging an opening on the upper surface of said slide block, said engaging opening being axially off-set on said slide block, a hinge plate secured to the sash, and a rotor arm joining said pinion and hinge plate whereby said sash is pivoted out and away from said frame when rotated on said pinion.

6. A device as claimed in claim 5 wherein said slide block has an arcuate indentation formed on the upper surface and said engaging opening is formed within the arcuate indentation whereby the rotor arm can swing within the arcuate indentation during pivoting of the sash.

7. A device as claimed in claim 5 wherein said lock engaging rod is spring biased within said opening by means of a compression spring mounted in said opening and axially aligned around said rod between the slide block and a retaining collar at the leading end thereof.

8. A pivoting and lock engaging device for use with a window or door sash comprising: a slide block, pivoting means for interconnecting said slide block with a sash for pivoting said sash away from planar alignment with a frame; a vertical opening through said slide block and spaced from said sash, with a lock engaging rod axially aligned therein, said lock engaging rod being spring biased within said opening whereby the leading end of said rod can be extended from the sliding block; a gripping tab at the opposite end of said rod for axially retracting the rod into the slide block; and a support pillar on said slide block for receiving said tab and retaining said axially retracted rod.

9. A device as claimed in claim 8 wherein said support pillar comprises a pair of pillars on diametrically opposed sides of said slide block opening.

10. A device as claimed in claim 9 wherein each of said pillars has an upper surface of predetermined rising elevation whereby axillary rotation of said gripping tab in one direction will cause the tab to ride up on said upper surface and thereby axially withdraw the rod within said opening, and rotation of said tab in the opposite direction will permit said rod to axially descend in said opening.

11. A device as claimed in claim 10 wherein each of said opposed pillars include a tab engaging surface at the upper end of said upper surface for retaining said tab and maintaining said rod axially retracted within said opening.

12. A device as claimed in claim 11 wherein said pivoting means includes a pivot hinge comprising a pinion for engaging an opening on the upper surface of said slide block, said engaging opening being axially off-set on said slide block, a hinge plate for securement to a sash, and a rotor arm joining said pinion and hinge plate.

13. A device as claimed in claim 12 wherein said slide block has an arcuate indentation formed on the upper surface and said engaging opening is formed within the arcuate indentation whereby the rotor arm can swing within the arcuate indentation during pivoting thereof.

14. A device as claimed in claim 12 wherein said lock engaging rod is spring biased within said opening by means of a compression spring mounted in said opening and axially aligned around said rod between the slide block and a retaining collar at the leading end thereof.

* * * * *